US009799310B2

(12) United States Patent
Damaschke et al.

(10) Patent No.: US 9,799,310 B2
(45) Date of Patent: Oct. 24, 2017

(54) GUITAR STRING TUNING AND ANCHOR SYSTEM

(71) Applicant: Hankscraft, Inc., Reedsburg, WI (US)

(72) Inventors: Kelly G. Damaschke, Loganville, WI (US); David M. Heuss, Lake Mills, WI (US)

(73) Assignee: Hankscraft, Inc., Reedsburg, WI (US)

( * ) Notice: Subject to any disclaimer, the term of this patent is extended or adjusted under 35 U.S.C. 154(b) by 0 days.

(21) Appl. No.: 15/240,433

(22) Filed: Aug. 18, 2016

(65) Prior Publication Data

US 2017/0061940 A1 Mar. 2, 2017

Related U.S. Application Data

(60) Provisional application No. 62/208,868, filed on Aug. 24, 2015.

(51) Int. Cl.
*G10D 3/12* (2006.01)
*G10D 3/14* (2006.01)

(52) U.S. Cl.
CPC ..... *G10D 3/12* (2013.01); *G10D 3/14* (2013.01)

(58) Field of Classification Search
CPC ..... G10D 3/14
See application file for complete search history.

(56) References Cited

U.S. PATENT DOCUMENTS

| | | | |
|---|---|---|---|
| D572,677 | S | 12/1896 | Goodwin |
| D976,428 | | 11/1910 | Benson |
| 1,476,712 | A | 12/1923 | Hafelfinger |
| 1,657,890 | A | 1/1928 | Mertes |
| 1,713,005 | A | 5/1929 | Rockwell |
| 1,792,608 | A | 2/1931 | Schulenberg |
| 2,162,007 | A | 6/1939 | Gambino |
| 2,232,218 | A | 2/1941 | Hubbard |
| 2,234,218 | A | 3/1941 | Abrams |
| 2,241,284 | A | 5/1941 | Walder |
| 2,304,597 | A | 12/1942 | Proelsdorfer |
| 2,322,137 | A | 6/1943 | Jauch |
| 2,397,289 | A | 3/1946 | Proll |
| 2,416,593 | A | 2/1947 | Proll |
| 4,004,485 | A | 1/1977 | Hiscott |
| 4,106,387 | A | 8/1978 | Alifano |
| 4,197,779 | A | 4/1980 | Holman |
| 4,202,240 | A | 5/1980 | Smith |
| 4,366,740 | A | 1/1983 | Tripp |

(Continued)

FOREIGN PATENT DOCUMENTS

| | | |
|---|---|---|
| EP | 2135235 B1 | 11/2012 |
| KR | 1020110002945 | 1/2011 |
| WO | 0033290 | 6/2000 |

OTHER PUBLICATIONS

U.S. Appl. No. 15/229,845, filed Aug. 5, 2016, 41pgs.

(Continued)

*Primary Examiner* — Kimberly Lockett
(74) *Attorney, Agent, or Firm* — Merchant & Gould P.C.

(57) ABSTRACT

A guitar string anchor includes a housing, a tension slide, and a tension slide adjuster operatively connected to the tension slide. The guitar string anchor is secured to a guitar bridge. The tension slide receives a ball end of a guitar string. The tension slide adjuster adjusts a position of the tension slide, which causes a change in the guitar string tension.

17 Claims, 19 Drawing Sheets

(56) References Cited

U.S. PATENT DOCUMENTS

| | | | |
|---|---|---|---|
| 4,426,907 | A | 1/1984 | Scholz |
| 4,608,905 | A | 9/1986 | Takabayashi |
| 4,608,906 | A | 9/1986 | Takabayashi |
| 4,655,116 | A | 4/1987 | Matsui |
| 4,690,027 | A | 9/1987 | Ido |
| 4,693,160 | A | 9/1987 | Hoshino |
| 4,696,218 | A | 9/1987 | Hoshino et al. |
| 4,712,463 | A | 12/1987 | Kubicki |
| 4,724,737 | A | 2/1988 | Fender et al. |
| 4,807,508 | A | 2/1989 | Yairi |
| 4,811,645 | A | 3/1989 | Cummings |
| 5,260,505 | A | 11/1993 | Kendall |
| 5,285,709 | A | 2/1994 | Grant |
| 5,477,764 | A | 12/1995 | Carrico |
| 5,542,330 | A | 8/1996 | Borisoff |
| 5,684,256 | A | 11/1997 | Rose |
| 5,696,335 | A | 12/1997 | Rose |
| 5,700,965 | A | 12/1997 | Rose |
| 5,705,760 | A | 1/1998 | Rose |
| 6,111,176 | A | 8/2000 | Rose |
| 6,143,967 | A | 11/2000 | Smith et al. |
| 6,184,450 | B1 | 2/2001 | LeBlanc |
| 6,528,710 | B2 | 3/2003 | Steinberger |
| 6,818,814 | B2 | 11/2004 | Park |
| 7,112,733 | B1 | 9/2006 | Babicz |
| 7,183,475 | B2 | 2/2007 | Van Halen |
| 7,309,824 | B2 | 12/2007 | LeBlanc |
| 7,351,895 | B1 | 4/2008 | LeBlanc |
| 7,394,005 | B1 | 7/2008 | Anderson et al. |
| 7,566,823 | B1 | 7/2009 | Nuttall |
| 7,592,528 | B2 | 9/2009 | Lyles |
| 7,847,170 | B1 | 12/2010 | Anderson et al. |
| 8,294,011 | B2 | 10/2012 | Toone |
| 9,190,032 | B2 | 11/2015 | Heuss |
| 9,196,232 | B2 | 11/2015 | Borisoff |
| 9,218,795 | B1 | 12/2015 | Woolery |
| 9,343,047 | B2 | 5/2016 | Gray et al. |
| 2002/0112591 | A1 | 8/2002 | Steinberger |
| 2003/0177883 | A1* | 9/2003 | Rose ..... G10D 3/04 84/298 |
| 2004/0159203 | A1 | 8/2004 | Van Halen |
| 2007/0095194 | A1 | 5/2007 | Moerth |
| 2007/0214932 | A1 | 9/2007 | Stalans |
| 2010/0000392 | A1 | 1/2010 | Uberbacher |
| 2010/0175534 | A1 | 7/2010 | McCabe |
| 2011/0011238 | A1 | 1/2011 | Toone |
| 2012/0318117 | A1 | 12/2012 | Deck |
| 2013/0139670 | A1 | 6/2013 | Goto |
| 2015/0310838 | A1 | 10/2015 | Borisoff |

OTHER PUBLICATIONS

Quick String Bridge Plate Protection Easy Installation—No Modifications Power Pins TM, BigRock Engineering Guitar Accessories, www.bigrockeng.com, 2pgs. (2012-2013).

Acoustic Nation, Product Spotlight: Power Pins, Guitar World, NewBay Media, LLC (NY), www.guitarworld.com, 5pgs. (2013).

PCT/I5A/220, Notification of Transmittal of International Search Report and The Written Opinion of the International Searching Authority, or the Declaration, 13pgs., WO201511649A1, May 8, 2015.

* cited by examiner

GUITAR STRING TUNING AND ANCHOR SYSTEM

CROSS REFERENCE TO RELATED APPLICATION

This application claims the benefit of U.S. patent application serial number 62/208,868 entitled "Guitar String Tuning and Anchor System," filed Aug. 24, 2015, the entirety of which is hereby incorporated by reference.

INTRODUCTION

Stringed acoustic instruments, such as an acoustic guitar, typically include a pin-in-hole configuration for securing a ball end of the string to the guitar bridge. The opposite end of the string, the non-ball end, is then secured to a peg on the headstock of the guitar. String tension is adjusted using a key on the headstock of the guitar.

The size of the holes in guitar bridges are non-uniform for different guitars. Additionally, different shapes and sizes of pins are used to form an interference fit with the hole and secure the ball end of the guitar string. In a typical guitar, guitar string tension can only be adjusted using the keys.

SUMMARY

In general terms, this disclosure is directed to an adjustable guitar bridge pin. Various aspects are described in this disclosure, which include, but are not limited to, the following aspects.

One aspect is a guitar string anchor. The guitar string anchor includes a housing, a tension slide supported by the housing, where the tension slide is configured to receive a ball end of a guitar string and to have the guitar string pass therethrough, and a tension slide adjuster operatively connected to the tension slide, where the tension slide adjuster is configured to adjust a position of the tension slide.

Another aspect is a guitar string fine tuner. The guitar string fine tuner includes a housing including a securing portion, a tension slide sized to fit within the housing, the housing defining a threaded channel, a stringing channel, and an inner surface. The stringing channel is configured to allow a guitar string to pass therethrough and the inner surface is configured to retain a ball end of the guitar string. The guitar string fine tuner also includes a tension slide adjuster that is threaded and sized to fit within the threaded channel, and configured to adjust a position of the tension slide, the lateral position defined along a central axis of the guitar string. The guitar string fine tuner also includes a securing component configured to couple to the securing portion.

Yet another aspect is a guitar string anchor system. The system includes an anchor including a bridge connector configured to secure the anchor to a bridge of a guitar, a tension slide supported by the anchor and sized such that at least a portion of the tension slide fits within an interior of the anchor, a position adjuster operatively connected to the tension slide, and a position adjuster retainer. The tension slide is configured to receive a ball end of a guitar string and to have the guitar string pass therethrough. The position adjuster causes the tension slide to move in a direction substantially parallel to a central axis of the guitar string. The position adjuster is configured to maintain contact between at least a portion of the position adjuster and the tension slide.

BRIEF DESCRIPTION OF THE DRAWINGS

The following figures, which form a part of this application, are illustrative of described technology and are not meant to limit the scope of the claims in any manner, which scope shall be based on the claims appended hereto.

DETAILED DESCRIPTION

Figure 1:
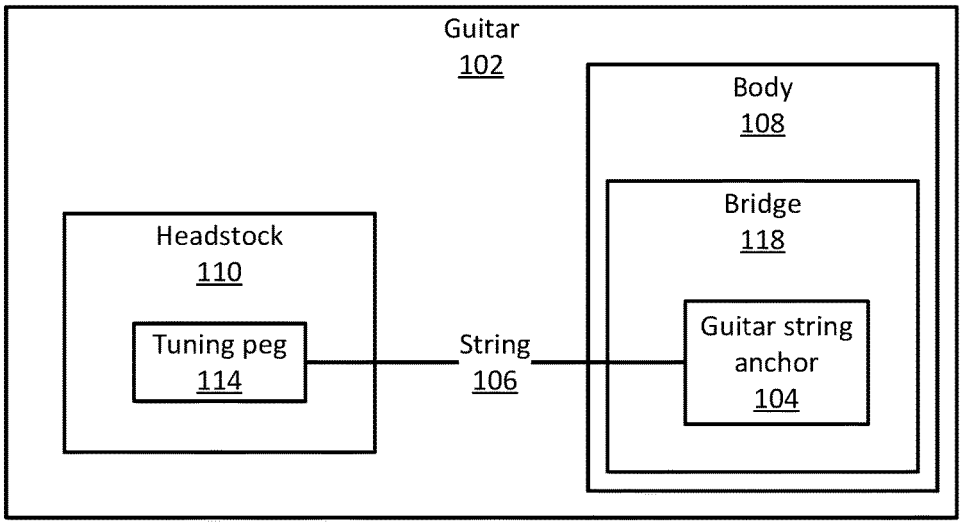
FIG. 1 is a block diagram of an exemplary of a system for securing a guitar string to a guitar.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As briefly described above, embodiments of the present invention are directed to securing a guitar string to a guitar. Existing securing devices have multiple deficiencies. For instance, conventional pegs can be particularly difficult to extract from the bridge holes when the pegs have been driven into the bridge with force. Additionally, the pegs can pop out of the bridge holes unexpectedly if they are not properly secured. When a peg loosens or comes out of the bridge hole, the string loses tension and the guitar becomes unplayable. This is unacceptable, especially during a live performance.

The pegs can also break when they are being removed from the bridge holes. Sometimes, a portion of the pegs remains in the bridge hole and it can be difficult to safely remove the broken portion and do so without damaging the guitar. Another problem with current peg-in-hole systems is that no standard bridge hole size or shape exists, which complicates the replacement process. Thus, finding an appropriately-sized peg can be a challenge. If the peg is too small, it can fall out, but if the peg is too large it will not push all the way into the bridge. Still another problem with existing securing means is that changing a guitar string can be time-consuming and awkward, especially during a live performance.

FIG. 1 is an environmental block diagram of an example guitar 102. The example guitar 102 includes a guitar body 108 with a guitar bridge 118, a guitar string anchor 104 positioned in the guitar bridge 118, a guitar string 106 that is anchored by the guitar string anchor 104 and a tuning peg 114 that is positioned on a headstock 110 of the guitar. The example guitar 102 is an acoustic guitar, although the guitar string anchor 104 can be used in other types of stringed instruments, such as, for example, a double bass, a viola, a violin, a cello, a sitar, a harp, a piano, or a lute. The example guitar 102 is an acoustic, six string guitar, including typical components such as a neck connecting the body and the headstock, frets, and sound hole. Other embodiments can include more or fewer components.

The tuning peg 114 secures the first end of the guitar string 106 and can be any tuning peg known in the art. The guitar string 106 can be made of a single material, such as, for example, steel, nylon, gut, or brass, or the guitar string 106 can be a wound string comprising a core and an overwinding. The guitar string 106 has a ball end, where the ball can be any polyhedra known in the art, such as, a cylinder, a sphere, a hemisphere, prism or a pyramid.

The example guitar string anchor 104 secures the second end of the guitar string 106. Example embodiments of the guitar string anchor 104, and its component parts, are shown and described in more detail with reference to FIGS. 2-19. The guitar string anchor 104 can be sized to fit various string instruments. The guitar string anchor 104 can be retrofitted into previously constructed string instruments and/or used in the construction of a new string instrument.

Figure 2:
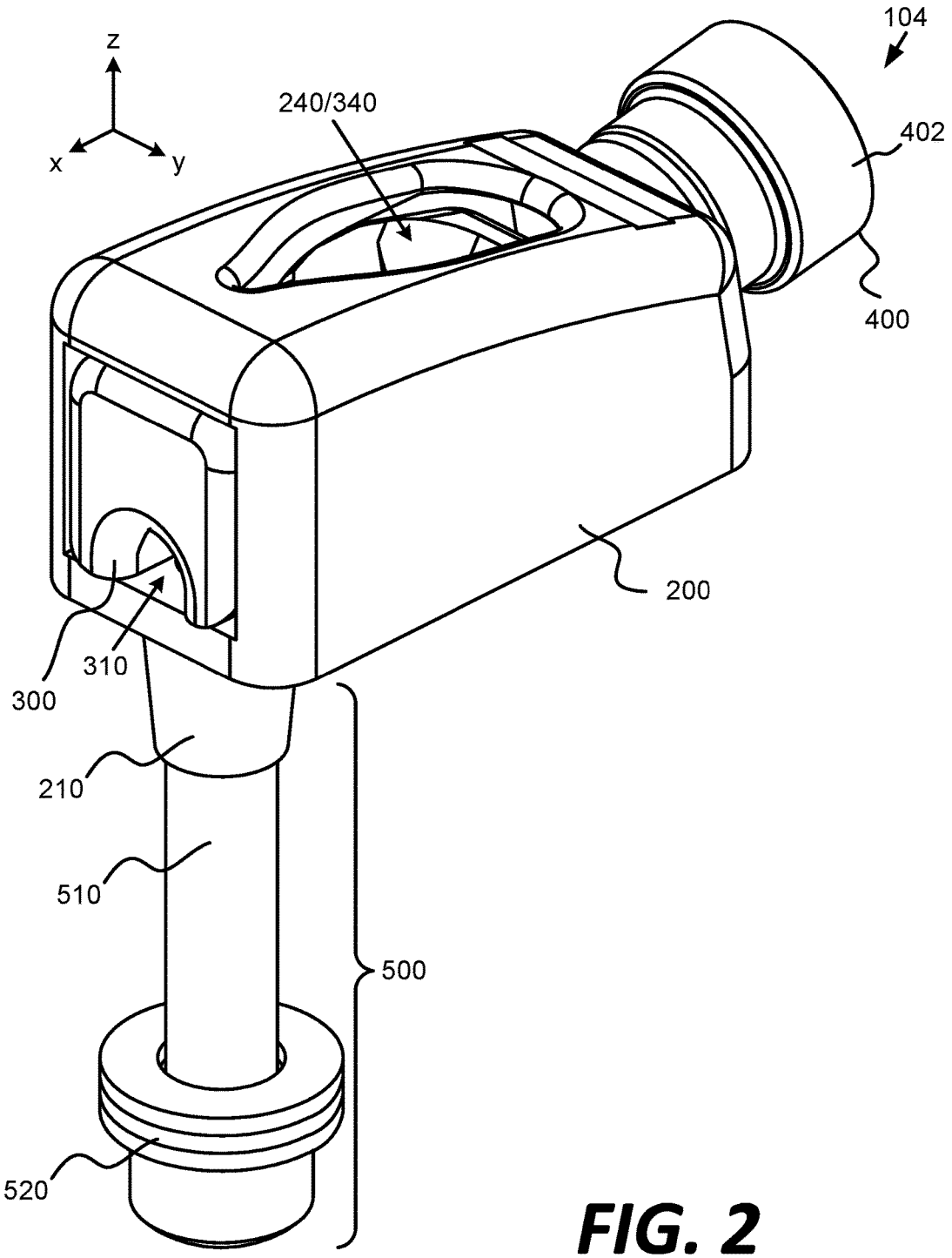
FIG. 2 is a front perspective view of an embodiment of a guitar string anchor.
Figure 3:
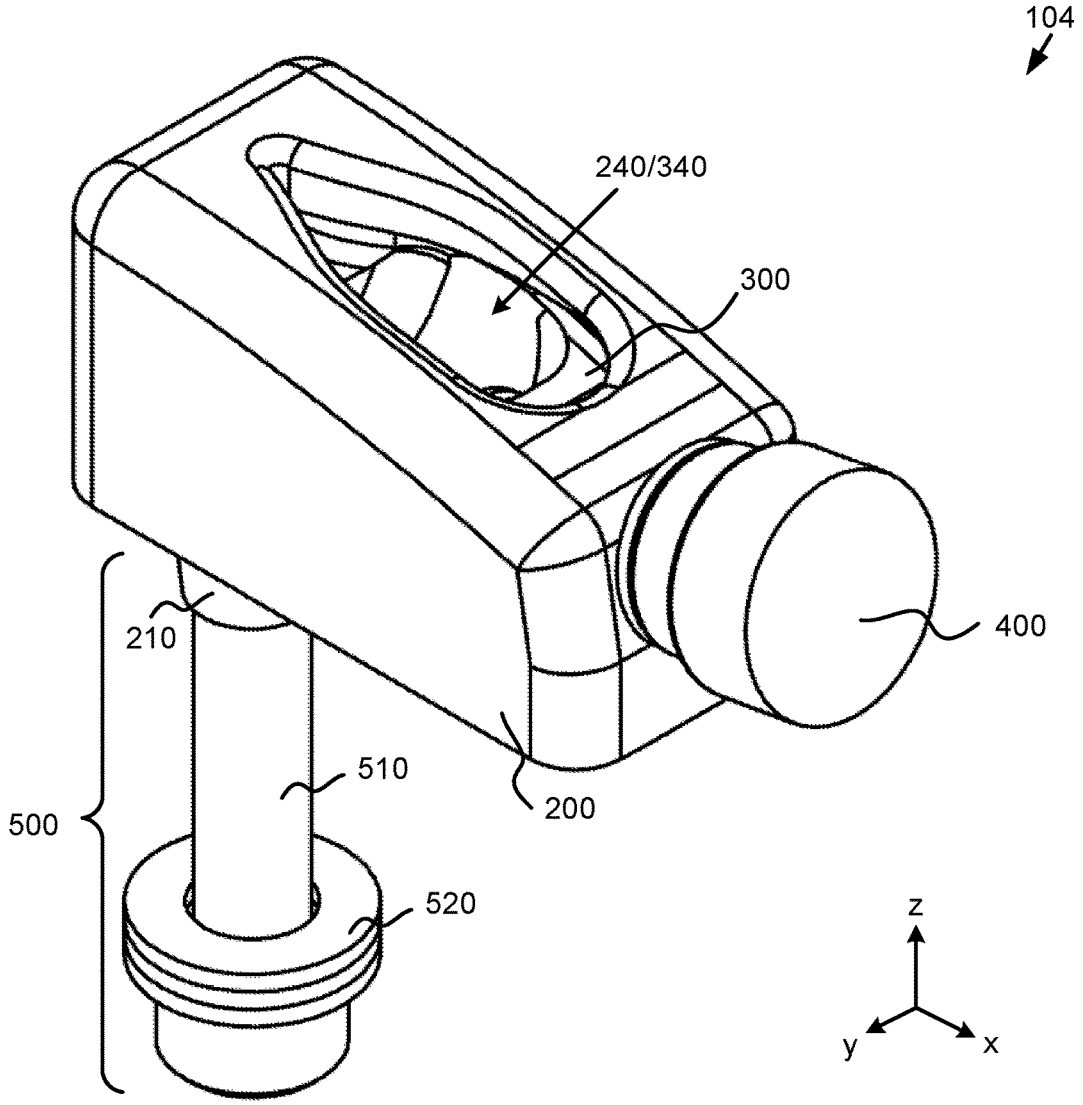
FIG. 3 is a rear perspective view of the embodiment of a guitar string anchor of FIG. 2.
Figure 8:
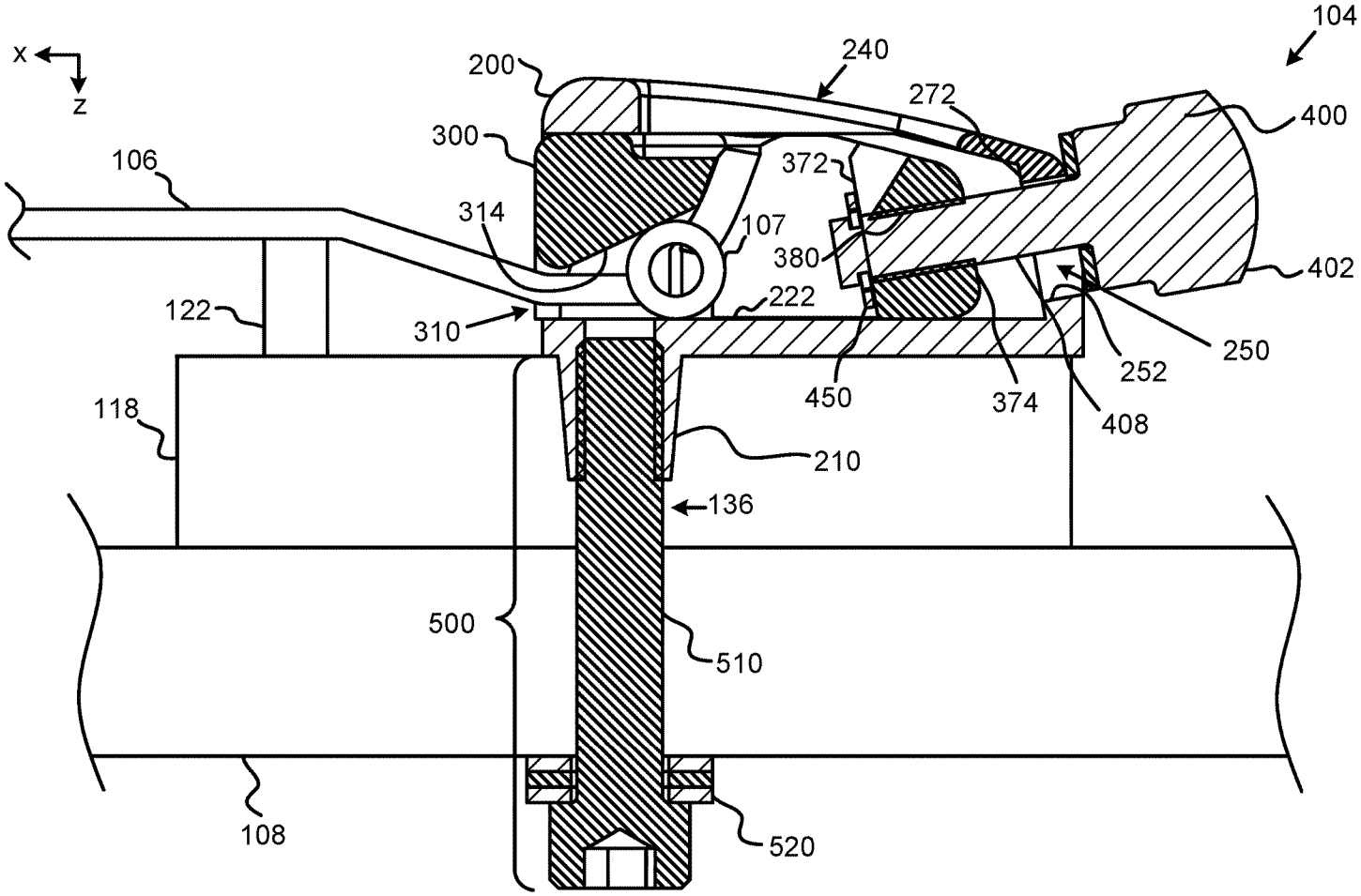
FIG. 8 is a cross-sectional view of a guitar string positioned in the embodiment of a guitar string anchor of FIG. 2, where the guitar string anchor is secured to the guitar and a tension slide is in a first position.

FIG. 2 illustrates a front perspective view of an embodiment of an example guitar string anchor 104. The embodiment of guitar string anchor 104 includes a housing 200, a tension slide 300, a tension slide adjuster 400, and a securing portion 500. Also shown is a stringing channel 310 defined by the tension slide 300, a top housing opening 240 defined by the housing 200 and a top tension slide opening 340 defined by the tension slide 300. FIGS. 3-7 illustrate a rear perspective view, a top view, a bottom view, a front view, and a rear view of the embodiment of guitar string anchor 104. FIG. 8 illustrates a cross-sectional view of the embodiment of guitar string anchor 104 with a string positioned within the embodiment of guitar string anchor 104. Other embodiments can include more or fewer components.

The embodiment of guitar string anchor 104 is secured to the bridge of a guitar using the securing portion 500. Then a non-ball end of a guitar string is passed through top openings 240 and 340 and stringing channel 310, and the string is secured to a tuning peg at a headstock of the guitar. Additional tightening or loosening of the guitar string can be accomplished using the tension slide adjuster 400, which causes the tension slide 300 to move along a longitudinal axis, which is the x-axis shown in FIG. 2.

The housing 200, tension slide 300, tension slide adjuster 400, and securing portion 500 are all separate pieces. However, in other embodiments, one or more of those components can be a single, integral piece. The housing 200 defines an inner cavity and the tension slide 300 is sized such that at least a substantial portion of the tension slide 300 fits within that cavity.

The tension slide adjuster 400 is operatively connected to the tension slide 300. In the embodiment shown, the tension slide adjuster 400 includes a threaded portion (visible in, for example, FIG. 8) sized to fit within a threaded hole in the tension slide 300. Tension slide adjuster 400 also includes a first end 402 that can be textured.

The housing 200, tension slide 300, tension slide adjuster 400, and securing portion 500 are, in various embodiments, aluminum, steel, stainless steel, chrome-plated aluminum, brass, iron, zinc, a plastic, or a composite material. In embodiments, housing 200 and tension slide 300 are constructed from the same type of material. For example, housing 200 and tension slide 300 are both aluminum. In other embodiments, housing 200 and tension slide 300 are constructed from different types of material. For example, housing 200 is stainless steel and tension slide 300 is chrome-plated aluminum. Tension slide adjuster 400 can be constructed from the same or a different type of material as housing 200 and tension slide 300.

Securing portion 500 includes a receiving cavity 210 defined by housing 200, a securing peg 510, and one or more optional pressure distributors 520. The one or more pressure distributors 520 are washers in the embodiment shown, although other types of pressure distributors can be used. Three pressure distributors 520 are shown in FIG. 2, although other embodiments include one, two, three, four, five or more pressure distributors, which can have identical or different thicknesses and diameters.

In the embodiment shown, securing peg 510 is removable from the receiving cavity 210. Securing peg 510 can be threaded and secure to a receiving cavity 210 that is threaded. Securing peg 510 can be secured to receiving cavity 210 in other ways, such as via an interference fit.

In other embodiments, securing peg 510 is integral to housing 200, i.e., housing 200 and securing peg 510 are not separate pieces. For example, securing peg 510 is cylindrical or partially conical in shape.

In embodiments, housing 200 is positioned on the guitar bridge and receiving cavity 210 is positioned at least partially in a guitar bridge hole. Then, the securing peg 510 is mated to the receiving cavity 210 from beneath the guitar bridge, i.e., from within a sound hole. The guitar string anchor 104 is secured to the guitar bridge by the compression from the underside of housing 200 and securing peg 510 with one or more pressure distributors 520.

Figure 4:
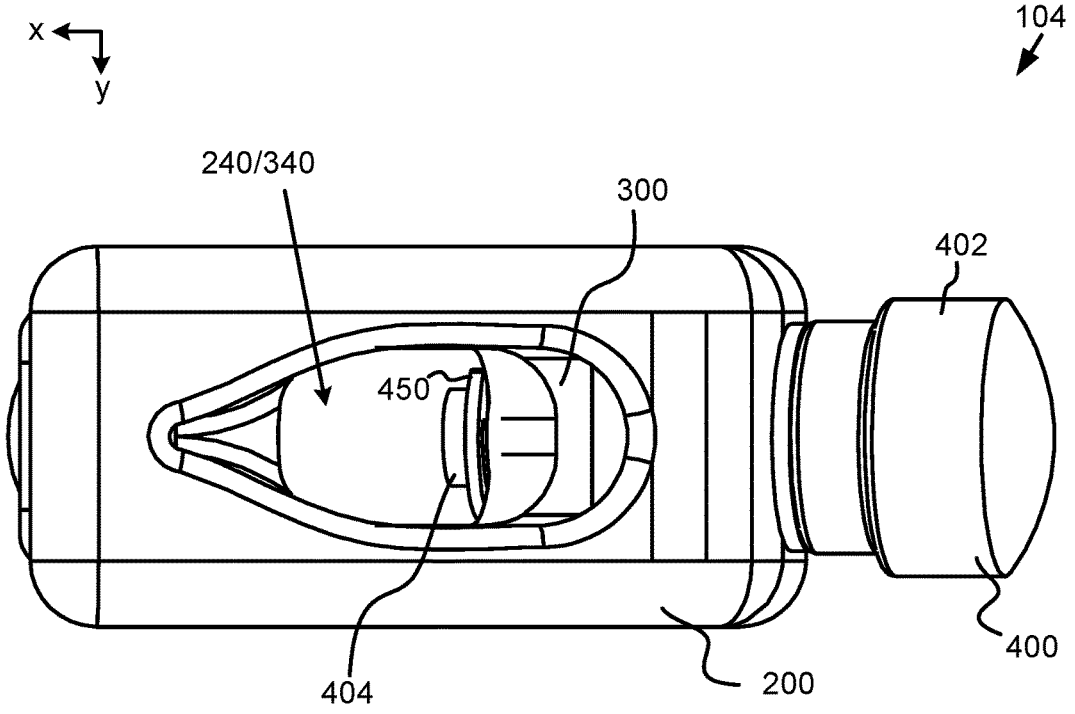
FIG. 4 is a top plan view of the embodiment of a guitar string anchor of FIG. 2.

FIG. 4 is a top view of the embodiment of example guitar string anchor 104 shown in FIG. 2. In this view, a tension slide adjuster retainer 450 is visible, as well as a first end 402 and a second end 404 of the tension slide adjuster 400. In embodiments, tension slide adjuster retainer 450 is positioned near or at the second end 404, such that the tension slide adjuster 400 cannot disconnect from the tension slide 300.

The top housing opening 240 is slightly larger than the top tension slide opening 340, as evidenced by a portion of the tension slide 300 being visible in the top view shown in FIG. 4. In other embodiments, the openings 240 and 340 are sized substantially the same.

Figure 5:
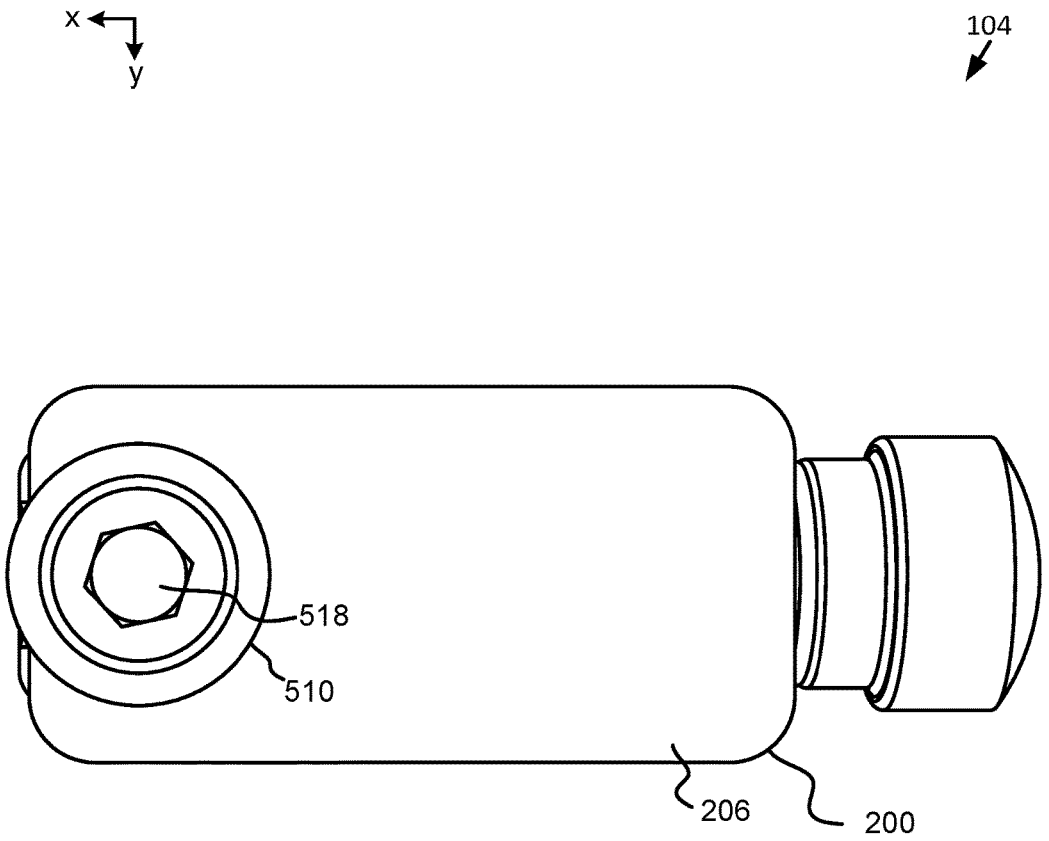
FIG. 5 is a bottom plan view of the embodiment of a guitar string anchor of FIG. 2.

FIG. 5 is a bottom view of the embodiment of example guitar string anchor 104 shown in FIG. 2. In this view, the bottom surface 206 of housing 200 is visible, as well as the bottom surface 518 of securing peg 510. The bottom surface 206 of housing 200 is planar or substantially planar, such that the housing 200 sits flush against the guitar bridge. The bottom surface 518 of securing peg 510 is concave and can include a socket, such as the hex socket shown in FIG. 5, although other types of screw drives are possible, such as slot, Phillips, etc. In other embodiments, securing peg 510 does not have a socket in the bottom surface 518.

Figure 6:
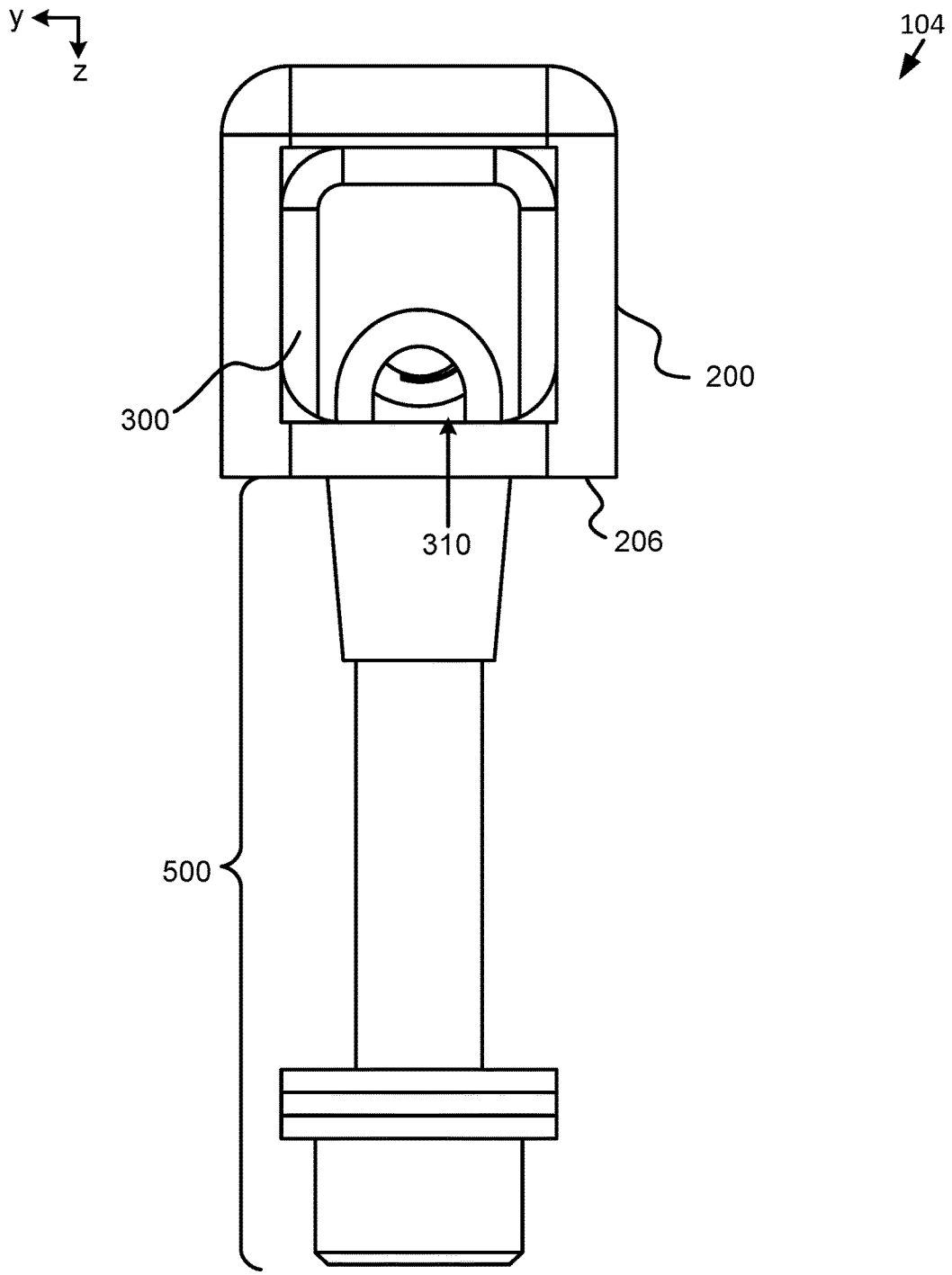
FIG. 6 is a front plan view of the embodiment of a guitar string anchor of FIG. 2.
Figure 7:
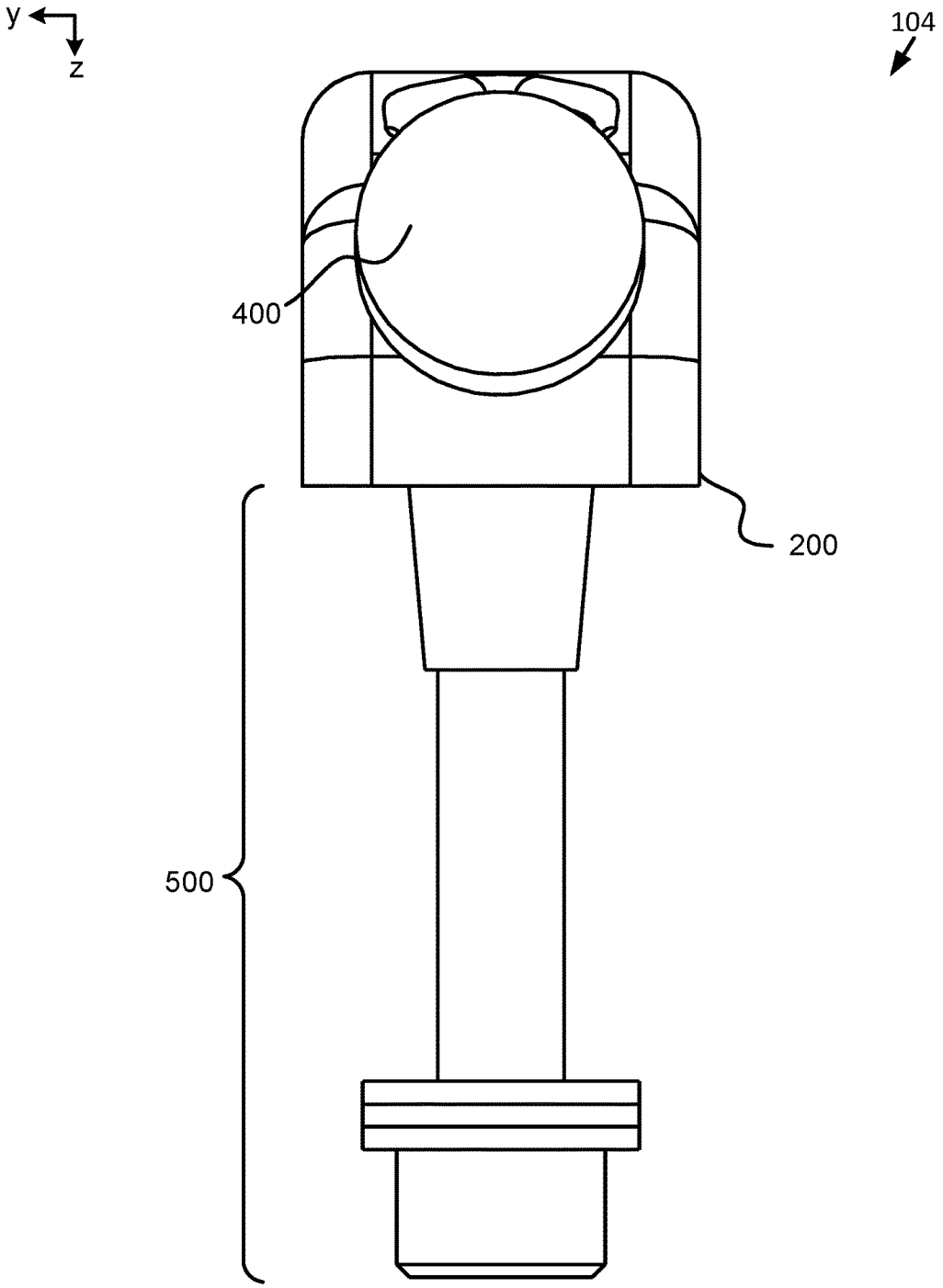
FIG. 7 is a rear plan view of the embodiment of a guitar string anchor of FIG. 2.

FIG. 6 is a front view of the embodiment of example guitar string anchor 104 shown in FIG. 2. This view shows the tension slide 300 within housing 200, stringing channel 310 and securing portion 500. As shown, the top, bottom, left and right sides of the tension slide 300 are flush against the respective inner surfaces of housing 200. Thus, during guitar playing, there is little to no movement of tension slide 300 because the spacing between the tension slide 300 and housing 200 inner surfaces limits the movement of tension slide 300. It is also evident from this view that bottom surface 206 of housing 200 is planar.

FIG. 8 is a cross-sectional view of the embodiment of example guitar string anchor 104 shown in FIG. 2 that has been secured to a guitar bridge 118 and guitar body 108 with securing portion 500. FIG. 8 shows a guitar string 106 with ball end 107, a guitar body 108, a guitar bridge 118, a bridge saddle 122, and a bridge hole 136. Also shown is a guitar string anchor 104 including housing 200, receiving cavity 210, bottom inner surface 222, top housing opening 240, rear opening 250, a back inner surface 272 of housing 200; the tension slide 300 including stringing channel 310, front inner surface 314, back inner surface 372, back outer surface 374, and threaded portion 380 of tension slide 300; tension slide adjuster 400 with first end 402 and threaded portion 408, and tension slide adjuster retainer 450. FIG. 8 shows the guitar string 106 passing through stringing channel 310. The non-ball end of guitar string 106 is secured to a tuning peg, not shown, at the headstock of the guitar, not shown. Other embodiments can include more or fewer components.

The guitar string anchor 104 sits on top of the guitar bridge 118, which is on top of the guitar body 108. Bridge saddle 122 is supported by guitar bridge 118. Bridge hole 136 passes through both the guitar bridge 118 and the guitar body 108. The relative thicknesses shown in FIG. 8 are illustrative only; thicknesses vary with different styles and different manufacturers.

As shown, the length of housing 200, along the x-axis, is such that the end partially hangs over the end of the guitar bridge 118. Again, different bridges have different lengths, so in other embodiments, the entirety of the bottom surface of housing 200 may be in contact with the guitar bridge 118.

Receiving cavity 210 passes into the top of bridge hole 136 and mates with securing peg 510, which passes into bridge hole 136 from underneath the bridge (via the guitar hole). Then, a user fastens securing peg 510, with one or more pressure distributors 520, which secures the guitar string anchor 104 to the guitar body 108 and guitar bridge 118.

The outside of receiving cavity 210 is tapered, which enables an interference fit with guitar bridge holes of different sizes. In other embodiments, the outside of receiving cavity 210 is straight and not tapered (that is, it is substantially cylindrical). Also, as shown, the inner surface of receiving cavity 210 is threaded and securing peg 510 is a thumbscrew.

The ball end 107 of the guitar string 106 is held in place by a front inner surface 314 of tension slide 300 and a bottom inner surface 222 of housing 200. The front inner surface 314 is concave and sloped towards the bottom inner surface 222 of housing 200. This design can accommodate different sizes and shapes of guitar string ball ends. The curved surface is visible in the bottom view of tension slide 300 shown in FIG. 17. In other embodiments, front inner surface 314 is curved or not sloped.

As shown, stringing channel 310 is oriented such that the guitar string 106 emerges from the guitar string anchor 104 at a point that is below the top of the bridge saddle 122 at the bridge saddle's 122 highest point above the bridge.

Tension slide adjuster 400 is operatively connected to tension slide 300 and causes tension slide 300 to move in a longitudinal direction (along the x-axis), which increases or decreases the amount of tension in the guitar string. In the depicted embodiment, the tension slide adjuster 400 interacts with the tension slide 300 via a threaded portion 380 on the tension slide 300. As the tension slide adjuster 400 rotates clockwise, the tension slide 300 moves away from the headstock of the guitar and increases string tension. Conversely, as the tension slide adjuster 400 rotates counterclockwise, the tension slide 300 moves toward the headstock of the guitar, where the string tension pulls the tension slide 300 toward the headstock, and decreases string tension.

Figure 9:
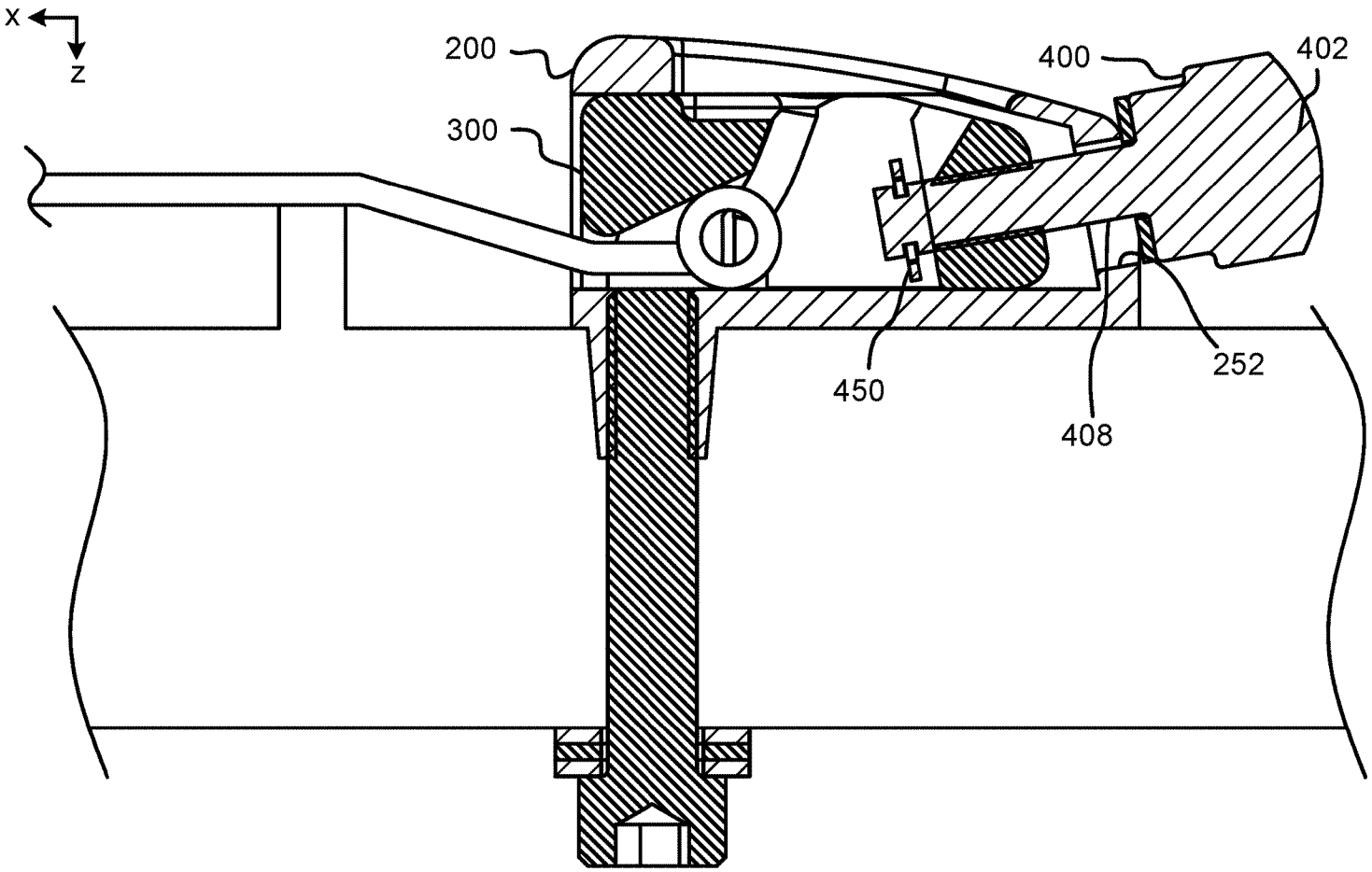
FIG. 9 is a cross-sectional view of a guitar string positioned in the embodiment of a guitar string anchor of FIG. 2, where the guitar string anchor is secured to the guitar and a tension slide is in a second position.
Figure 10:
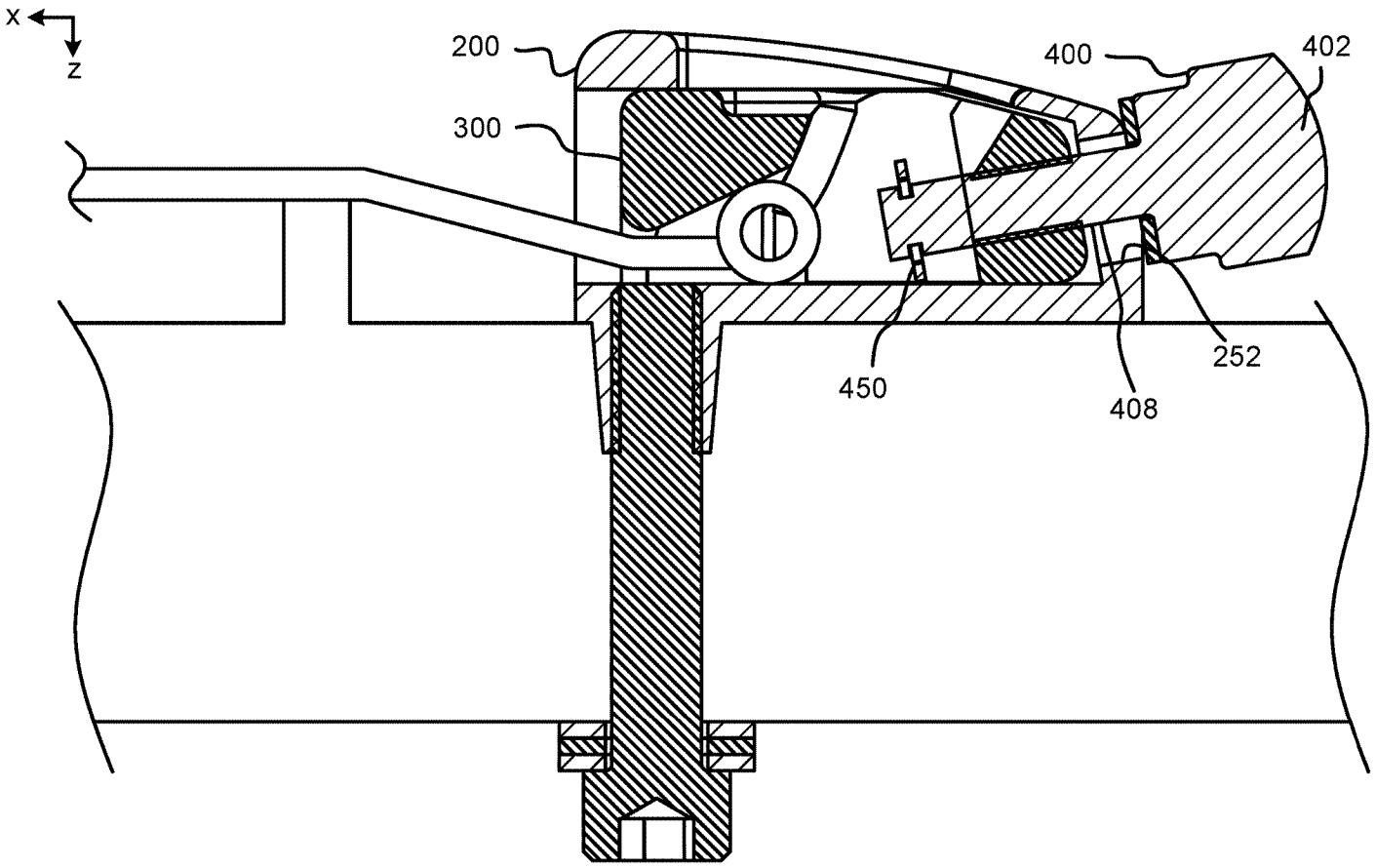
FIG. 10 is a cross-sectional view of a guitar string positioned in the embodiment of a guitar string anchor of FIG. 2, where the guitar string anchor is secured to the guitar and a tension slide is in a third position.

FIG. 8 shows the tension slide 300 in the minimum tension position, that is, where the ball end 107 is positioned closest to the tuning peg. FIG. 9 depicts an intermediate tension position and FIG. 10 shows a nearly maximum tension position. As used herein, minimum and maximum tension are relative terms comparing the position of the tension slide 300 to the headstock, and relative to the position of the tension slide 300 within housing 200, where the guitar string has been secured to the tuning peg and the tuning peg has not been adjusted.

The minimum tension position in FIG. 8 is evidenced by contact between the back inner surface 372 of the tension slide 300 and the tension slide adjuster retainer 450. That is, the tension slide adjuster retainer 450 prevents the tension slide 300 from moving any closer to the headstock of the guitar than that shown in FIG. 8. In FIG. 9, the tension slide adjuster 400 has been used to cause the tension slide 300 to move away from the headstock of the guitar, which causes the ball end 107 of the guitar string 106 to move, which in turn lengthens the guitar string and increases the tension in the guitar string. In FIG. 10, the tension slide adjuster 400 has been used to cause the tension slide 300 to move further away from the headstock of the guitar than the position in FIG. 9. In FIG. 10, the tension slide is at or near the maximum tension position.

In embodiments, the tension slide 300 can move between the maximum tension position and the minimum tension position about 0.125 inch; about 0.1 inch; about 0.9 inch; about 0.8 inch; about 0.75 inch; about 0.7 inch; about 0.6 inch; about 0.5 inch; about 0.4 inch; about 0.3 inch; about 0.25 inch; about 0.2 inch; about 0.1 inch; or about 0.05 inch. These distances are along the x-axis.

As shown in FIG. 8, a central longitudinal axis (not shown in FIG. 8) of tension slide adjuster 400 makes an about 10° angle with the bottom inner surface 222 of housing 200. The angle of the central longitudinal axis of tension slide adjuster 400 is determined by a bore angle of the threaded portion 380 of tension slide 300. In other embodiments, the angle is about 0°, about 5°, about 7.5°, about 8°, about 9°, about 11°, about 12.5°, about 14°, about 15°, about 16°, about 17°, about 18°, about 19° or about 20°.

Threaded portion 408 of tension slide adjuster 400 passes through rear opening 250 to interact with the threaded portion 380 of tension slide 300. As the tension slide 300 moves away from the headstock of the guitar, the tension slide adjuster 400 moves toward the guitar bridge 118. That is, the first end 402 and the threaded portion 408 of tension slide adjuster 400 move in parallel in the z-axis direction when tension slide adjuster 400 is rotated and tension slide 300 moves in the x-axis direction. In embodiments, a spring is positioned around the threaded portion 408 and between the back outer surface 374 of tension slide 300 and the back inner surface 272 of housing 200.

The vertical movement of tension slide adjuster 400 is apparent when comparing the distance from the bottom surface 252 of rear opening 250 to the threaded portion 408 of tension slide adjuster 400 in FIGS. 8-10. That is, the distance between threaded portion 408 and bottom surface 252 decreases between the positions in FIG. 8 as compared to FIG. 9. Then the distance decreases in FIG. 10 as compared to FIG. 9 as the tension slide 300 moves further away from headstock. The total vertical movement of tension slide adjuster 400 between the fully extended (as shown in FIG. 8) and fully retracted (substantially what is shown in FIG. 10) positions is about 0.01 inch; about 0.02 inch; about 0.03 inch; about 0.05 inch; about 0.06 inch; about 0.07 inch; about 0.08 inch; about 0.09 inch; or about 0.1 inch.

Figure 11:
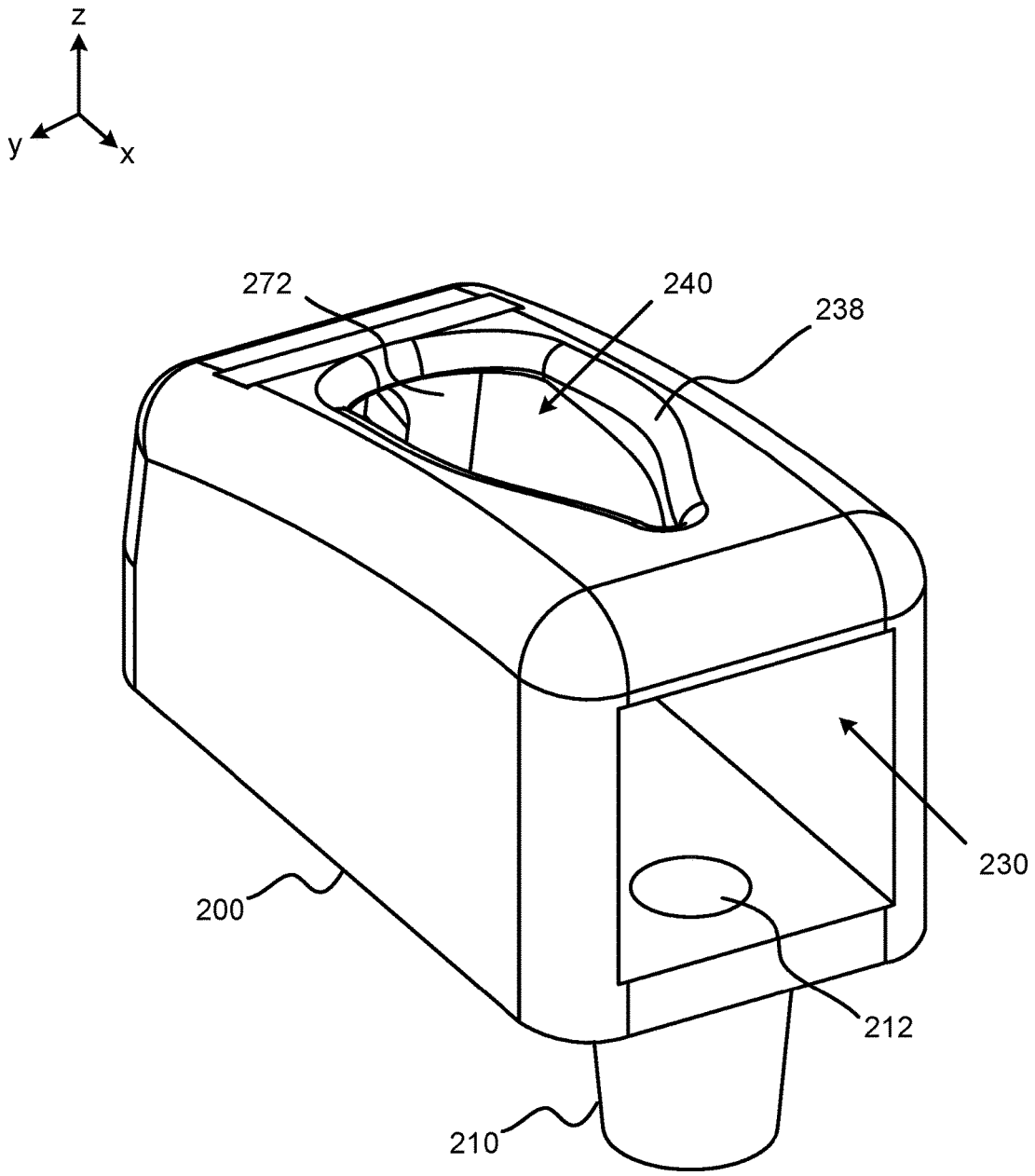
FIG. 11 is a front perspective view of an embodiment of a guitar string anchor housing.

FIGS. 11-14 illustrate various views of the embodiment of example housing 200. FIG. 11 is a front perspective view of housing 200 without tension slide 300 or securing peg 510. The view in FIG. 11 shows receiving cavity 210 with inner surface 212, front opening 230, mouth 238 that defines top housing opening 240, and back inner surface 272. Housing 200 has rounded outer edges and surfaces, but other embodiments can have defined vertices. Other embodiments can include more or fewer components.

Mouth 238 defines top housing opening 240. As shown, the sides of mouth 238 are sloped such that their surfaces are not normal to the top surface of housing 200. However, in other embodiments, the sides of mouth 238 are normal or substantially normal to the top surface of housing 200.

As shown, top housing opening 240 has a pear-shaped cross section. In other embodiments the cross section of top housing opening 240 is circular, oval, square, rectangular, or a different shape. Generally, top housing opening 240 is sized such that most or all conventional guitar string ball ends can pass through.

Front opening 230 is substantially rectangular in cross-sectional shape. The dimensions of front opening 230 correspond to the outer surface dimensions of tension slide 300 such that tension slide 300 can fit through front opening 230, but movement in the y- and z-axes directions are substantially limited.

Figure 12:
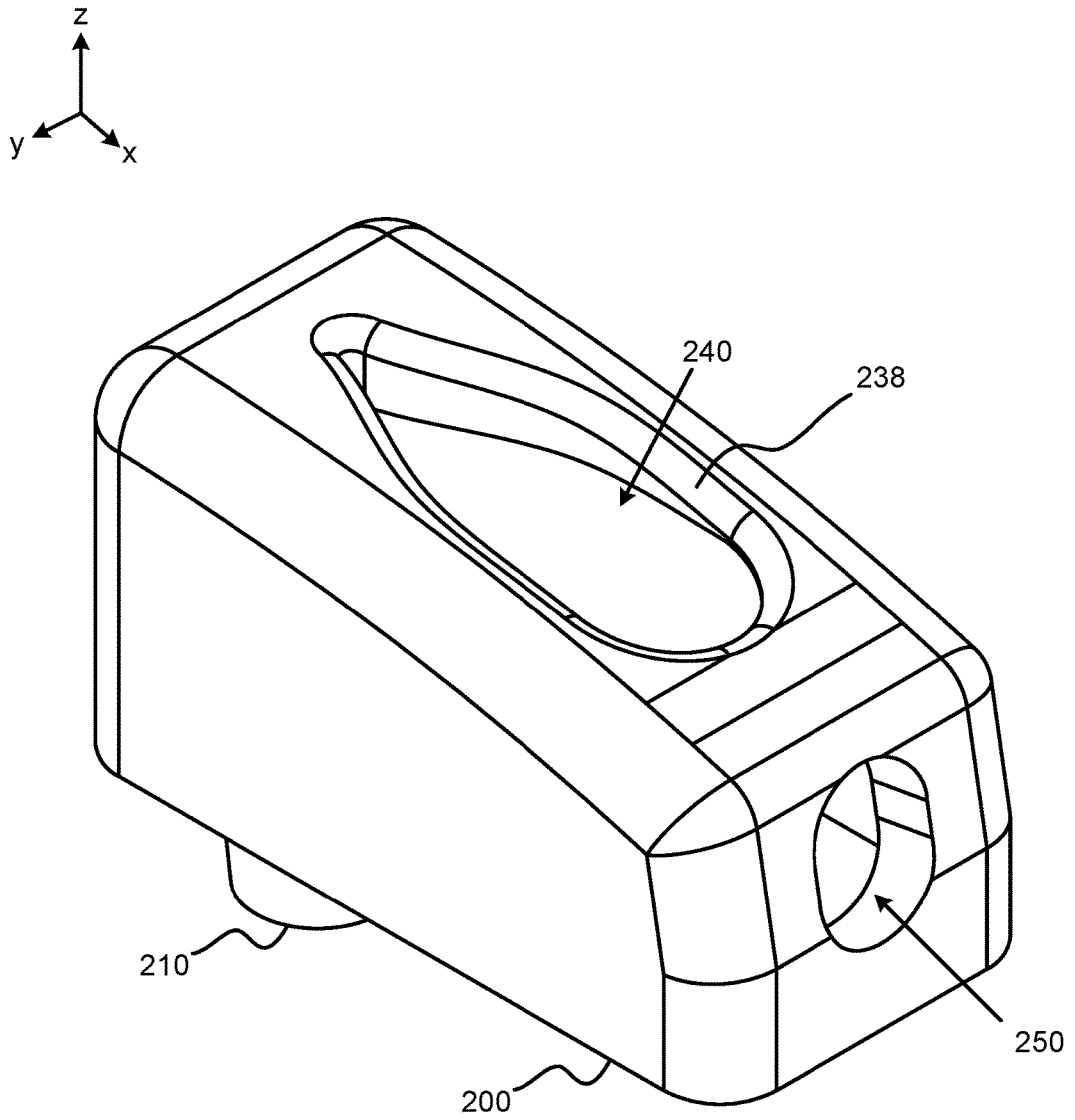
FIG. 12 is a rear perspective view of the embodiment of a guitar string anchor housing shown in FIG. 11.
Figure 13:
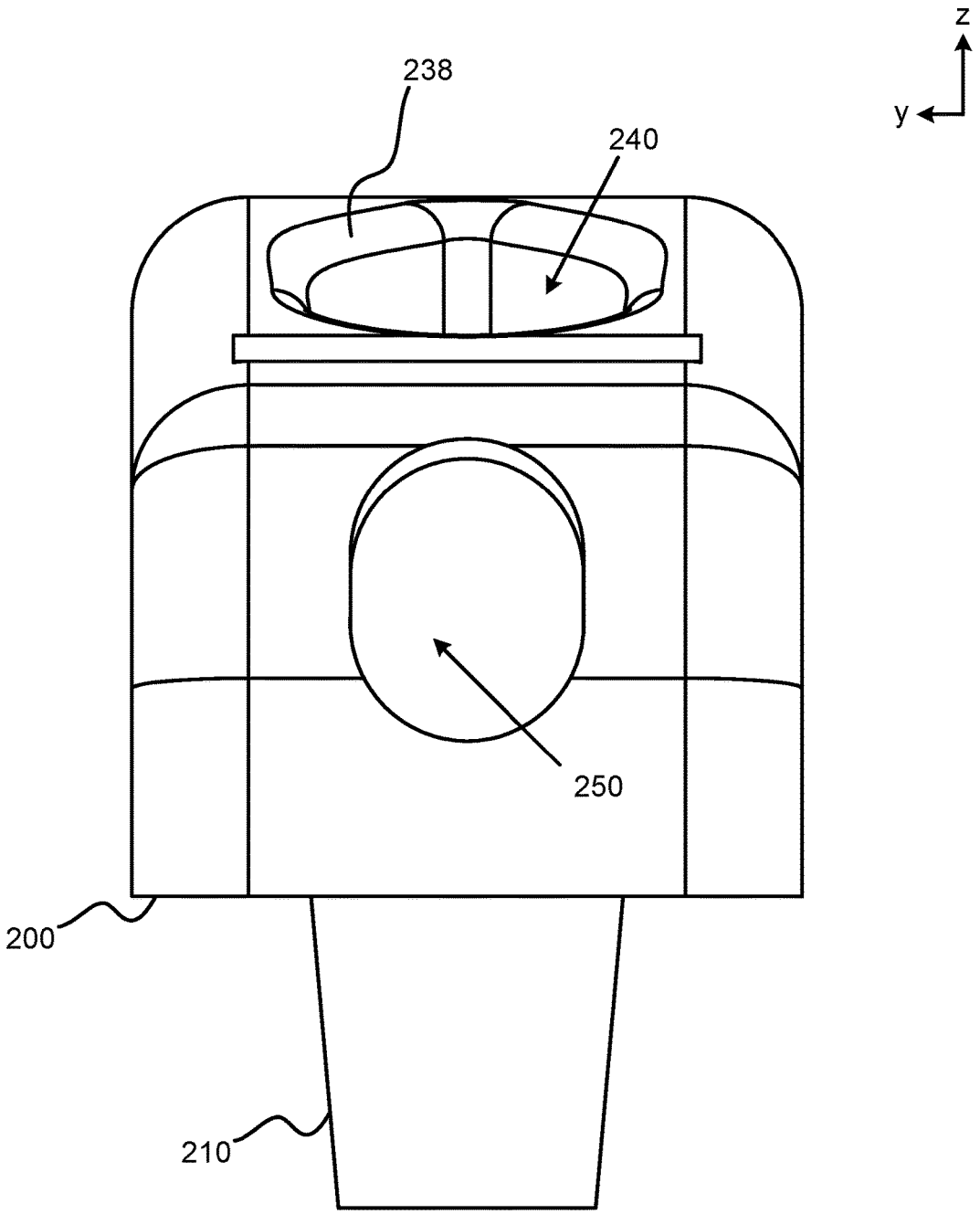
FIG. 13 is a rear plan view of the embodiment of a guitar string anchor housing shown in FIG. 11.
Figure 14:
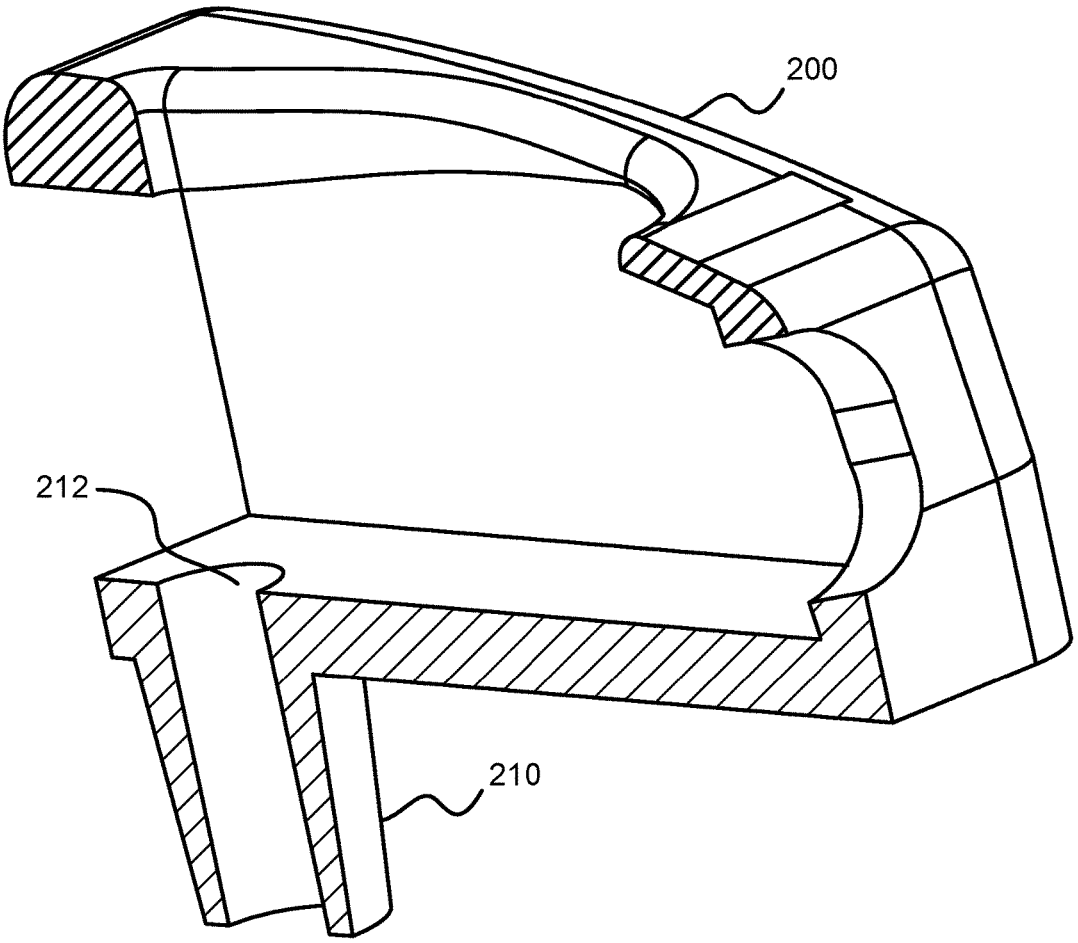
FIG. 14 is a cross-sectional perspective view of the embodiment of a guitar string anchor housing shown in FIG. 11.
Figure 15:
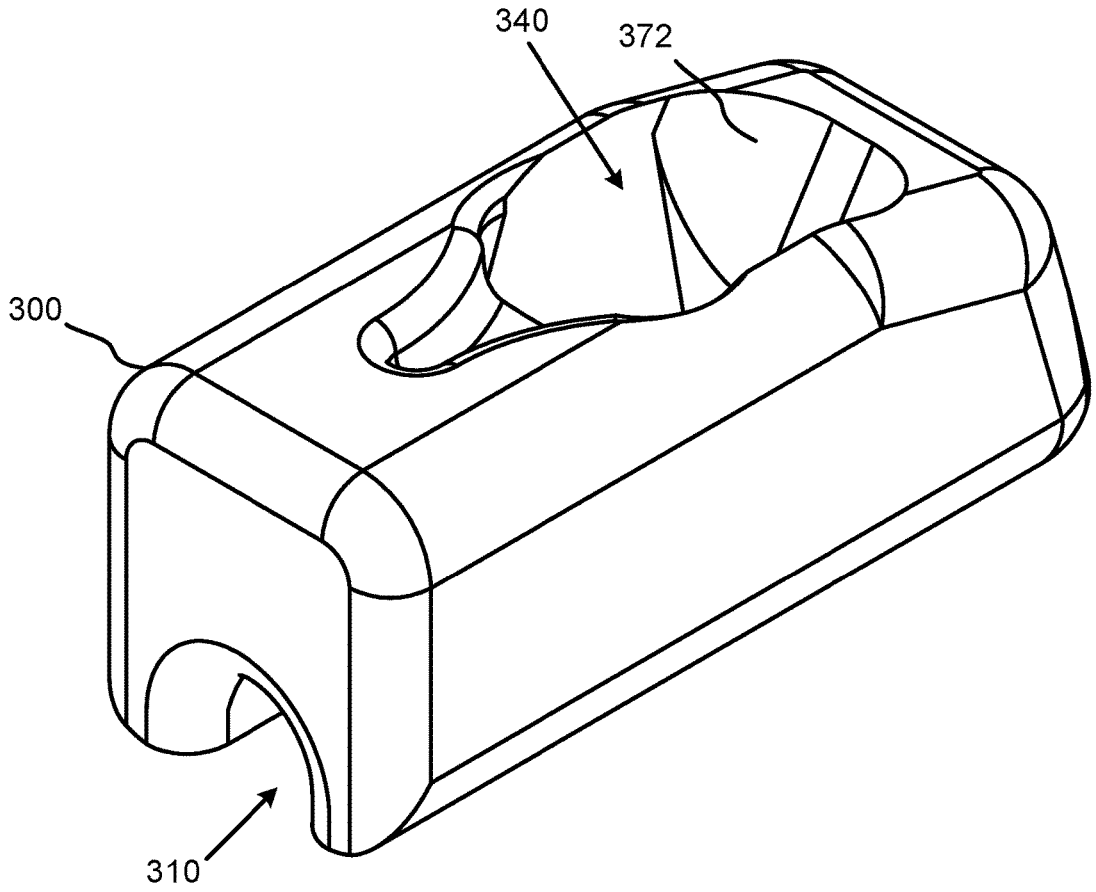
FIG. 15 is a front perspective view of an embodiment of a guitar string anchor tension slide.
Figure 16:
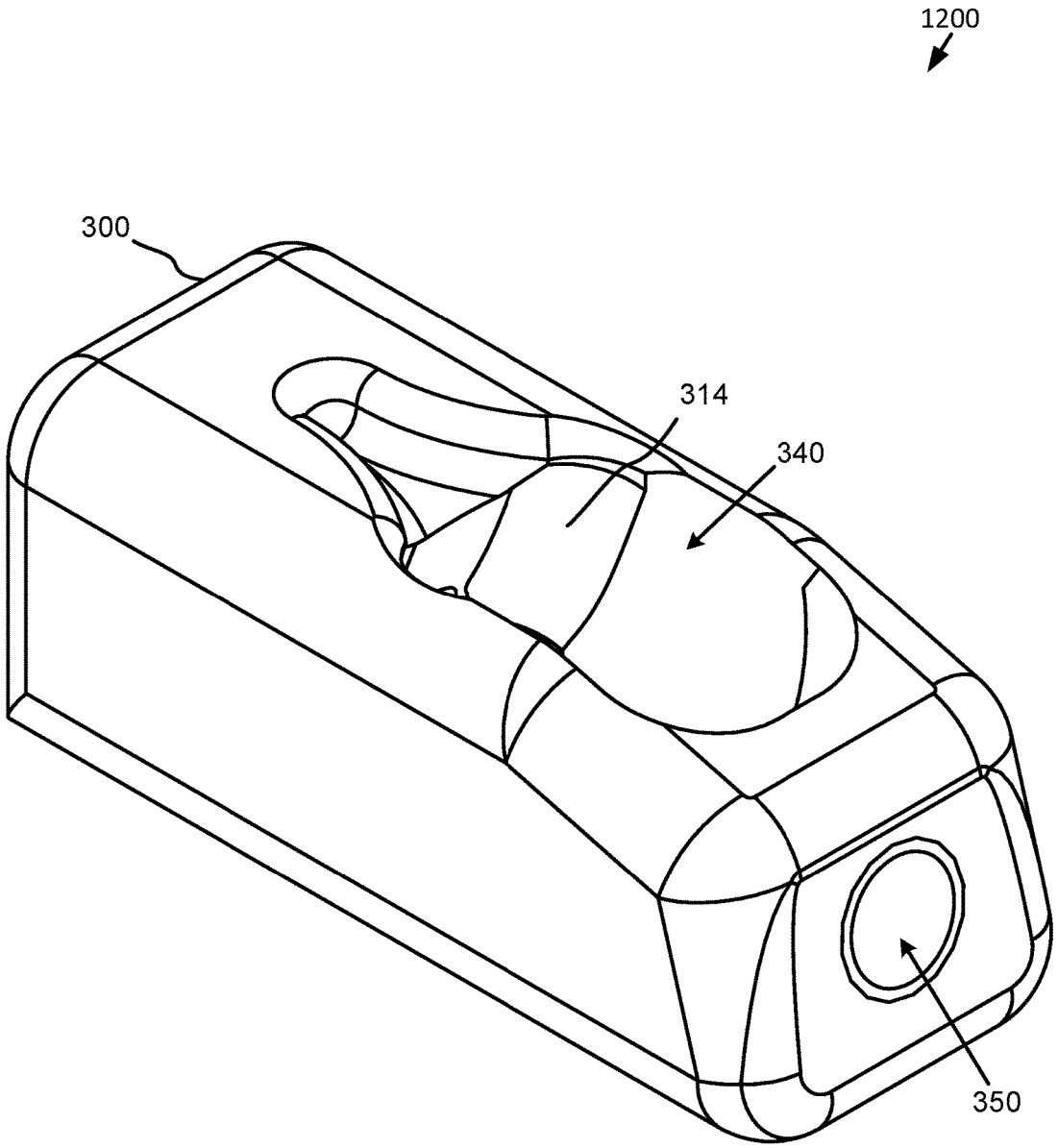
FIG. 16 is a rear perspective view of the embodiment of a guitar string anchor tension slide shown in FIG. 15.
Figure 17:
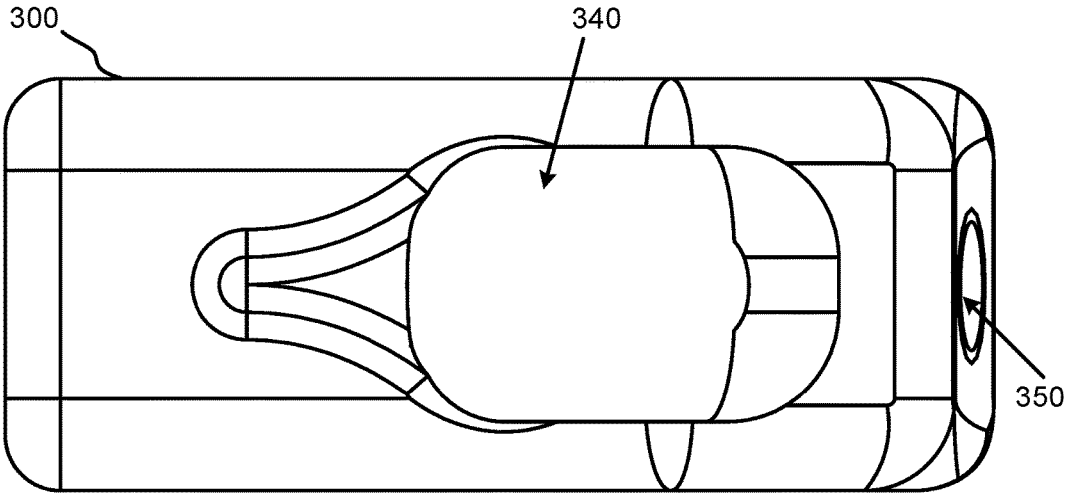
FIG. 17 is a top plan view of the embodiment of a guitar string anchor tension slide shown in FIG. 15.
Figure 18:
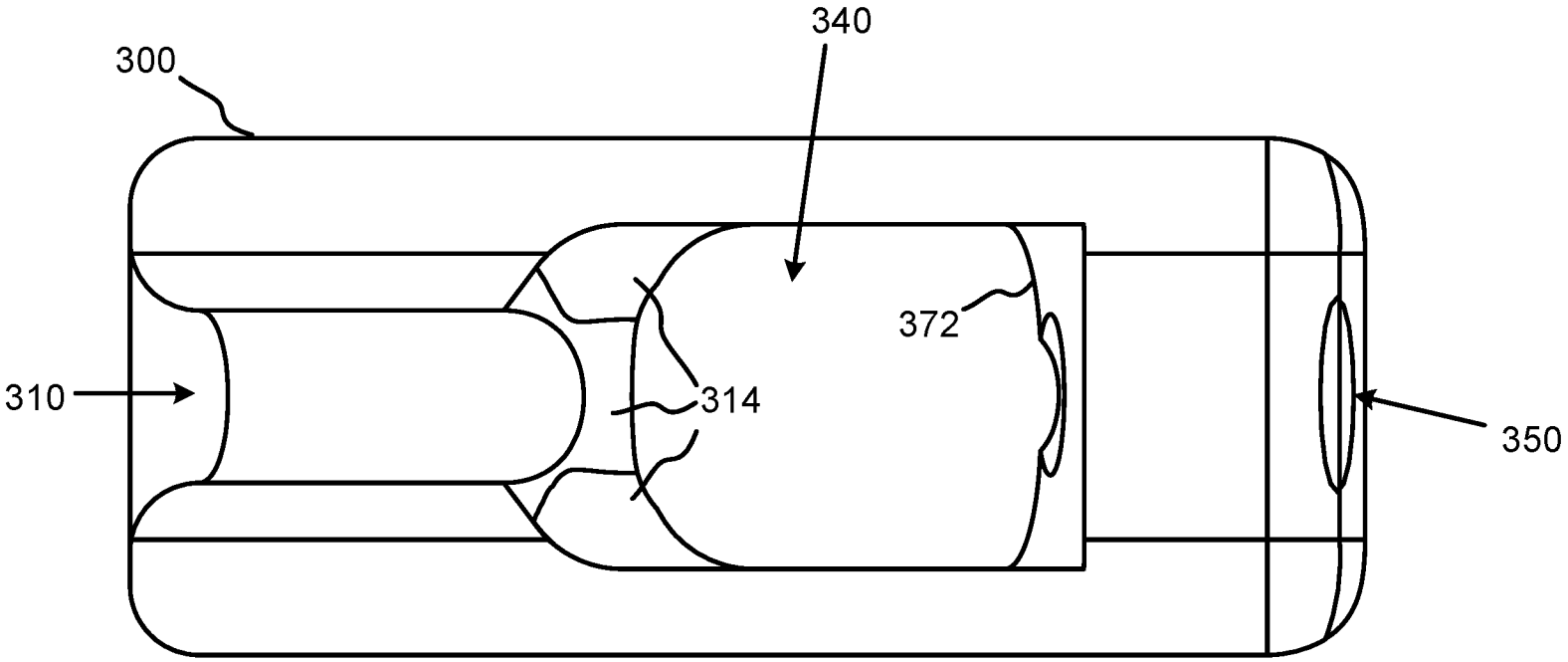
FIG. 18 is a bottom plan view of the embodiment of a guitar string anchor tension slide shown in FIG. 15.

FIG. 12 illustrates a rear perspective view of the embodiment of housing 200 also shown in FIG. 11. The view in FIG. 12 shows receiving cavity 210, rear opening 250, and mouth 238 that defines top housing opening 240. Other embodiments can include more or fewer components.

In this view, rear opening 250 is visible. The cross section of rear opening 250 is an oblique straight oval. This design enables the tension slide adjuster 400 to move in the z-direction. Other embodiments can have different cross-sectional shapes for rear opening 250, such as rectangular, oval, square, etc.

FIGS. 15-18 illustrate various views of embodiment of example tension slide 300. The views show tension slide 300, stringing channel 310, top tension slide opening 340, rear opening 350, front inner surface 314 and back inner surface 372.

Figure 19:
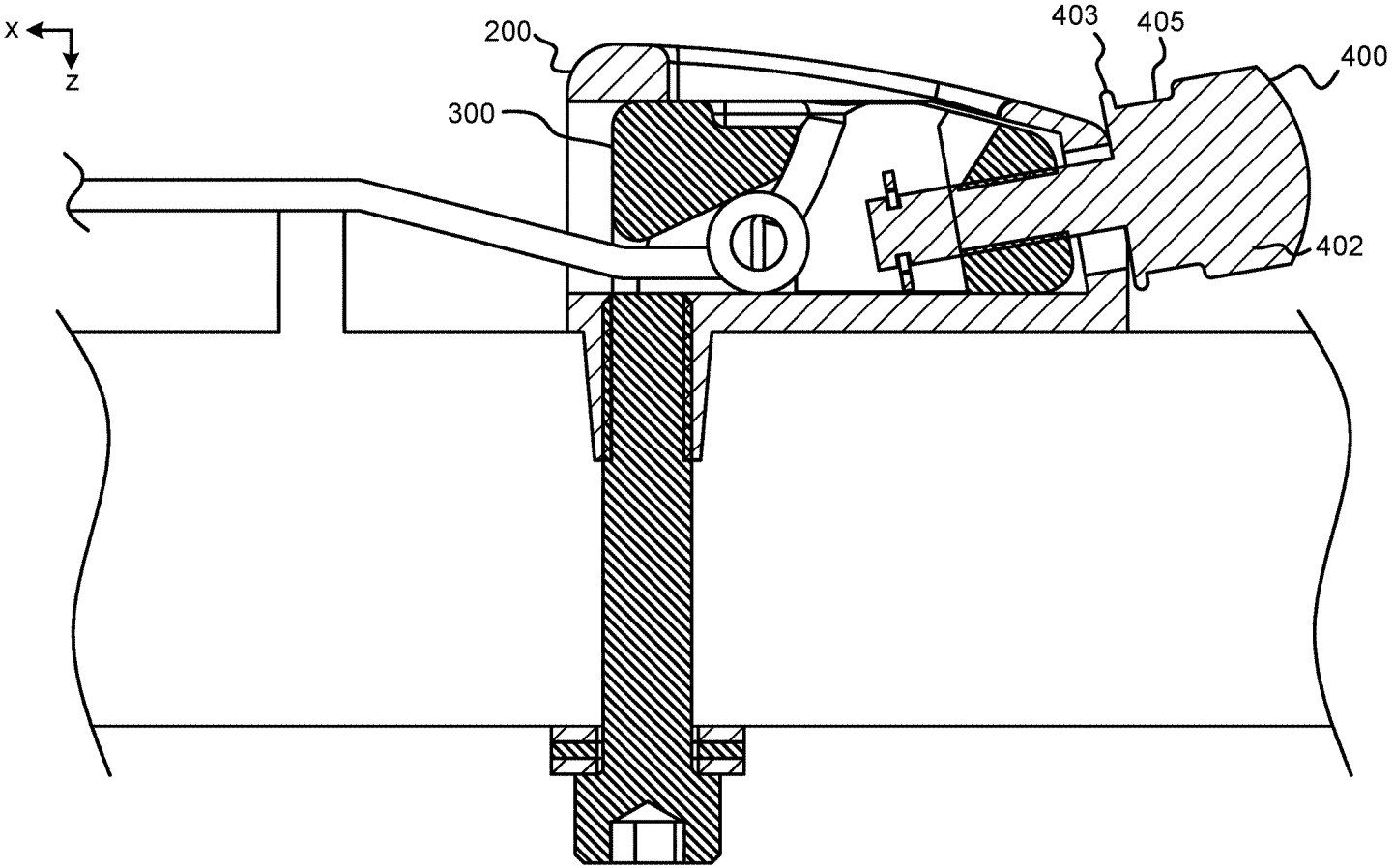
FIG. 19 is a cross-sectional view of an alternate embodiment of a guitar string anchor.

FIG. 19 illustrates a cross-sectional view of another embodiment of an example tension slide adjuster 400 that is operatively connected to a tension slide 300 in housing 200. As shown in FIG. 19, the tension slide adjuster 400 includes a lower flange 403 as part of the first end 402. The flange 403 has a circular cross-sectional shape. Flange 403 eases, compared to the embodiment shown in FIG. 8, the vertical movement of the tension slide adjuster 400 as the position of the tension slide 300 changes. The improved movability is partially attributable to distributing pressure against the curved back surface of housing 200.

In other embodiments, flange 403 is not integral with the tension slide adjuster 400. Instead, a washer is positioned between the first end 402 of tension slide adjuster 400, shown in FIGS. 2-10, and the housing 200. That is, the washer is positioned in a similar location as flange 403 shown in FIG. 19.

In the embodiment of example guitar string anchor 104 shown in FIGS. 2-19, six guitar string anchors 104 would be used for a six-string acoustic guitar. That is, a guitar string anchor 104 would be inserted into each of the six bridge holes. Alternate embodiments, not shown, include a configuration where one guitar string anchor includes six tension slides and six position adjusters. There, a single, integral housing defines openings for the tension slides and the position adjusters. Similar to the embodiment of example guitar string anchor 104 shown in FIGS. 2-19, each tension slide is independently adjustable.

In embodiments, the single, integral housing includes two, three, four, five or six securing portions. For example, in one embodiment the single housing includes four securing portions that pass through the first, third, fourth, and sixth guitar bridge holes.

In some embodiments, the guitar string anchor 104 can include a piezoelectric transducer (piezo pick-up), which can be in communication with an amplifier, sound effect board, or other electronic processing device. In these embodiments, a piezoelectric transducer is positioned within the tension slide 300 or within the housing 200.

The piezo pick-ups are in electronic communication with a control unit via, for example, an electric wire. For example, an electric wire connects to the piezo pick up, on one end, and a wireless signal transmitter or electronic jack mounted in the guitar body 108, on the other end. The electric wire can pass through the bridge 118 of the guitar and may also pass through the housing 200. An electronic signal passes from the piezo pickup through the jack or wireless signal transmitter to a control unit which can enable adjustment of volume, tone or frequency-dependent processing of the audio signals from each of the guitar strings. This control unit may also provide pre-amplification of the guitar's sound. The control unit can in turn be in communication with a sound amplifier.

In yet another embodiment, a piezo pickup on the acoustic guitar enables the guitar player to tune the guitar via a tuner mounted into the body 108 of the guitar. The tuner is in electronic communication with the piezo pickup.

Traditional acoustic guitar piezo pickups are mounted below or within the bridge. These traditional piezo pickups combine the vibration of all six guitar strings into one electronic signal. The instantly-described configurations enable the control of volume, tone, frequency-dependent processing of audio signals (equalization), or effect and amplification of each individual guitar string. This can provide the guitar player with increased flexibility in customizing the sound of the guitar.

The diagrams depicted herein are just examples. There may be many variations to these diagrams described therein without departing from the spirit of the disclosure. For instance, components may be added, deleted or modified.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussions regarding ranges and numerical data. Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 4 percent to about 7 percent" should be interpreted to include not only the explicitly recited values of about 4 percent to about 7 percent, but also include individual values and sub-ranges within the indicated range. Thus, included in this numerical range are individual values such as 4.5, 5.25 and 6 and sub-ranges such as from 4-5, from 5-7, and from 5.5-6.5; etc. This same principle applies to ranges reciting only one numerical value. Furthermore, such an interpretation should apply regardless of the breadth of the range or the characteristics being described.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

What is claimed is:

1. A guitar string anchor, comprising:

a housing;

a tension slide supported by the housing, wherein the tension slide is configured to receive a ball end of a guitar string, and wherein the tension slide is configured to have the guitar string pass therethrough;

a tension slide adjuster operatively connected to the tension slide, wherein the tension slide adjuster is configured to adjust a position of the tension slide;

a bridge connector configured to pass into a guitar bridge hole of a guitar; and a tension slide adjuster retainer, wherein at least a portion of the tension slide adjuster is positioned within the housing;

wherein the tension slide adjuster retainer is configured to maintain contact between at least a portion of the tension slide adjuster and the tension slide; and wherein the tension slide adjuster moves less than about 0.02 inch, but more than 0.0 inch, in a vertical direction substantially normal to a central axis of the guitar string, between a fully-extended position and a fully-retracted position.

2. The guitar string anchor of claim 1, wherein the tension slide includes a threaded cavity, and wherein the tension slide adjuster is threaded and sized to fit within the threaded cavity.

3. The guitar string anchor of claim 2, wherein the tension slide moves in a direction parallel to a central axis of the guitar string.

4. The guitar string anchor of claim 2, wherein the bridge connector forms an interference fit with the guitar bridge hole.

5. The guitar string anchor of claim 2, wherein the guitar string anchor further defines a threaded securing cavity;

wherein a portion of the bridge connector passes through the guitar bridge hole, wherein a portion of the bridge connector is threaded and sized to fit within the threaded securing cavity; and wherein the guitar string anchor is secured to a body of the guitar at least in part by the bridge connector.

6. The guitar string anchor of claim 1, further comprising a piezoelectric transducer.

7. A guitar string fine tuner, comprising:

a housing including a securing portion;

a tension slide sized to fit within the housing, the tension slide defining a threaded channel, a stringing channel, and an inner surface;

wherein the stringing channel is configured to allow a guitar string to pass therethrough; and wherein the inner surface is configured to retain a ball end of the guitar string;

a tension slide adjuster that is threaded and sized to fit within the threaded channel, wherein the tension slide adjuster is configured to adjust a position of the tension slide, the position defined along a central axis of the guitar string; and a securing component configured to couple to the securing portion.

8. The guitar string fine tuner of claim 7, further comprising a tension slide adjuster retainer.

9. The guitar string fine tuner of claim 8, wherein at least a portion of the tension slide adjuster is positioned within the housing; and wherein the tension slide adjuster retainer is configured to maintain contact between at least a portion of the tension slide adjuster and the tension slide.

10. The guitar string fine tuner of claim 9, wherein the housing further defines a tension slide adjuster opening through which the tension slide adjuster passes and operatively connects to the tension slide.

11. The guitar string fine tuner of claim 9, further comprising a piezoelectric transducer.

12. The guitar string fine tuner of claim 11, wherein the piezoelectric transducer is is supported by the tension slide.

13. The guitar string fine tuner of claim 9, further comprising:

a first pressure distributor positioned on the tension slide adjuster; and a second pressure distributor positioned on the securing component, wherein both the securing component and the securing portion are threaded.

14. The guitar string fine tuner of claim 9, wherein the tension slide has a minimum lateral position and a maximum lateral position, and wherein a difference between the minimum lateral position and the maximum lateral position is about 0.125 inch.

15. The guitar string fine tuner of claim 14, wherein the difference between the minimum lateral position and the maximum lateral position is about 0.01 inch.

16. A guitar string anchor system, comprising:

an anchor including a bridge connector configured to secure the anchor to a bridge of a guitar;

a tension slide supported by the anchor and sized such that at least a portion of the tension slide fits within an interior of the anchor, wherein the tension slide is configured to receive a ball end of a guitar string; and wherein the tension slide is configured to have the guitar string pass therethrough;

a position adjuster operatively connected to the tension slide, wherein the position adjuster causes the tension slide to move in a direction substantially parallel to a central axis of the guitar string; and a position adjuster retainer, wherein the position adjuster retainer is configured to maintain contact between at least a portion of the position adjuster and the tension slide.

17. The guitar string anchor system of claim 16, further comprising:

a first pressure distributor supported by the position adjuster; and a piezoelectric transducer;

wherein the tension slide moves less than 0.125 inch in the direction substantially parallel to the central axis of the guitar string from a fully-extended position to a fully-retracted position;

wherein the position adjuster moves less than about 0.02 inch, but more than 0.0 inch, in a vertical direction substantially normal to the central axis of the guitar string between the fully-extended position and the fully-retracted position.

* * * * *